US005555996A

United States Patent [19]

Lang-Ree et al.

[11] Patent Number: 5,555,996

[45] Date of Patent: Sep. 17, 1996

[54] BAG-IN BOX WITH SPLIT LID

[75] Inventors: Arne Lang-Ree, Manhattan Beach; William P. Apps, Anaheim; Jeff Ackermann, Manhattan Beach, all of Calif.

[73] Assignee: Rehrig Pacific Company, Los Angeles, Calif.

[21] Appl. No.: 102,746

[22] Filed: Aug. 6, 1993

[51] Int. Cl.[6] ..... B65D 90/04

[52] U.S. Cl. ..... 220/403; 222/105; 220/345; 206/505; 206/509; 206/511

[58] Field of Search ..... 206/504, 505, 206/506, 508, 509, 511, 512; 220/403, 343, 345, 335; 222/105

[56] References Cited

U.S. PATENT DOCUMENTS

| | | | |
|---|---|---|---|
| D. 197,311 | 1/1964 | Spaak . | |
| D. 257,528 | 11/1980 | Cherry . | |
| D. 329,931 | 9/1992 | Apps . | |
| 2,347,980 | 5/1944 | Apfelbaum | 220/343 |
| 3,126,120 | 3/1964 | Crate | 220/343 |
| 3,282,462 | 11/1966 | Box . | |
| 3,295,714 | 1/1967 | DiAddario | 220/343 |
| 3,463,345 | 8/1969 | Bockenstette . | |
| 3,568,879 | 3/1971 | Box | 206/504 |
| 3,616,943 | 11/1971 | Brink | 214/10.5 R |
| 3,759,416 | 9/1973 | Constantine . | |
| 3,840,115 | 10/1974 | Ladewig . | |
| 3,940,018 | 2/1976 | Scholle | 206/506 |
| 3,998,327 | 12/1976 | Box . | |
| 4,161,261 | 7/1979 | Frater | 220/337 |
| 4,548,320 | 10/1985 | Box . | |
| 4,620,644 | 11/1986 | Miller . | |
| 4,685,567 | 8/1987 | Webb . | |
| 4,688,675 | 8/1987 | Miller et al. | 206/508 |
| 4,742,933 | 5/1988 | Panick | 206/511 |
| 4,765,480 | 8/1988 | Malmanger . | |
| 4,789,075 | 12/1988 | Sun | 220/4 F |
| 5,025,945 | 6/1991 | Lyon | 220/345 |
| 5,330,069 | 7/1994 | Jamison et al. | 220/343 |
| 5,335,820 | 8/1994 | Christianson | 222/105 |
| 5,353,948 | 10/1994 | Lanoue et al. | 220/343 |

FOREIGN PATENT DOCUMENTS

| | | | |
|---|---|---|---|
| 1089786 | 11/1990 | Canada | 206/508 |
| 435584 | 5/1967 | Switzerland | 220/343 |
| 2141778 | 1/1985 | United Kingdom . | |
| 2171980 | 10/1986 | United Kingdom . | |
| 2204023 | 11/1988 | United Kingdom . | |

OTHER PUBLICATIONS

Lewis Systems Catalog, p. 26, 1983.

*Primary Examiner*—Stephen J. Castellano
*Attorney, Agent, or Firm*—Banner & Allegretti, Ltd.

[57] ABSTRACT

A box or container assembly formed of plastics material and particularly adapted for use in a beverage syrup supply system is covered by opposed lid members whose exposed surface contains an organization of channel-defining projections for stacking superposed containers optionally in columnar- or cross-stacked array. A hinge arrangement effects release from the container of any lid subjected to an excessive lateral force and enables the lids, when open, to be held against the container body with minimal lateral flair for compact nesting. Various forms of access openings are described for accessing a syrup bag spigot and for attaching same when the container assembly forms part of a beverage syrup supply system.

18 Claims, 16 Drawing Sheets

BAG-IN BOX WITH SPLIT LID

BACKGROUND OF THE INVENTION

The present invention relates to boxes, containers or cases formed of molded plastic material, such as polyethylene, polypropylene, or the like, for use in storing and transporting goods. The invention is particularly adapted for the transport and storage of unstable bulk commodities such as, for example, beverage syrups or post mixes.

United States patent application Ser. No. 07/493,728, filed Mar. 14, 1990 by William P. Apps, the disclosure of which is incorporated herein by reference, describes a box or container system of the concerned type particularly adapted for use in a beverage syrup delivery system. The boxes or containers embodied in that patent application comprise open-top bodies that are formed, for example, of high-density polypropylene and are adapted to receive a flexible bag containing beverage syrup. The boxes are particularly designed for vertical nesting by the cooperative effects of the body profile represented by alternating projections and recesses from the box body walls and, for stacking, by a flange extending about a rim around the top opening, as well as the presence of feet and lugs thereon for fixing the relative position of the stacked boxes. Moreover, the box walls are downwardly and inwardly inclined whereby the aforementioned projections and intermediate recesses cooperate to enhance compact internesting of the boxes. In order to accommodate exposure of a spigot attached to each beverage syrup bag, each box, preferably on one end wall, is provided with an opening designed to permit release of the spigot from the box, as well as a means for fixing the spigot to the box for ready access at a time of use.

Boxes or containers, according to United States patent application Ser. No. 07/493,728, although constituting a significant improvement over comparable boxes or containers of the prior art, suffer the problems that, being open-topped, the contents of the boxes, e.g., beverage syrup bags, are exposed to possible damage during storage or shipment. Additionally, due to the fluid nature of the contained bags, the bags have a tendency to migrate out of the boxes while traversing conveyors along steep inclines. Also, when the bodies of the boxes or containers are formed of walls having a relatively thin transverse section, the fluid nature of the stored contents tends to create a twisting and/or bowing of the walls of the boxes when, due to movement, the liquid syrup undergoes fluid motion within the respective bags.

It is the amelioration of these problems, therefore, to which the present invention is directed.

SUMMARY OF THE INVENTION

According to the invention, therefore, there is provided a container assembly organization incorporating lid members for closing the tops of the containers during periods of storage, shipment or use when contents are housed within the containers. Due to the particular configuration of the lid members and the cooperating portions of the container bodies, the containers can, when empty, be compactly nested without interference from the opened lids. Moreover, due to the formation on the exterior surfaces of the lid members of a particular channel structure for positionally receiving the feet of a superposed container, the containers can be optionally stacked in a columnar or cross-stacking mode.

Specifically, therefore, according to a principle aspect of the invention, there is provided a container assembly comprising an open-topped container body including a generally rectangular bottom and rectangularly arranged opposed side and end walls extending upwardly from the bottom, a pair of opposed lid members each having a side edge pivotally secured to the upper end of the respective side walls for pivotal movement between a generally horizontal position closing the top of the container body and an open condition in which the lid members are generally vertically disposed in close proximity to the respective adjacent side walls, at least one hinge element on each container side wall and a cooperating hinge element on each of the lid members for operative engagement therewith, the lid members including a generally flat region adjacent the side edge and having a stiffening portion adjacent each hinge element thereon, and the container side walls containing a recess adjacent each hinge element thereon disposed and sized to receive the stiffening portion adjacent the cooperating lid member hinged element.

The lid members are advantageously hinged to the container bodies in a manner to effectively retain the lids attached to the bodies during periods of normal use of the assemblies. At the same time, however, the hinge arrangements are particularly designed to permit release of the lids from hinged engagement with the container bodies when a lid may be subjected to an extraordinary force as, for example, may be caused by a lid being jammed or hung up during transit. Thus, the container assembly organization according to the invention can accommodate untoward forces that, while possibly damaging a lid, leaves the more-expensive container body free of damage.

The lid members are further formed on their exterior surfaces with mutually spaced, raised portions forming a series of projections and intermediate channels uniquely configured to enable the containers, with the lid members in a closed condition, to be stacked in alternate arrays. Moreover, the exterior surface of the bottom of each container body is provided with formed projecting feet members adapted to be accommodated in alternative positions in the channels formed in the lid and to be snugly received therein whereby the container stack can be effectively stabilized.

According to a particular aspect of the invention, as for example when the container assemblies are used as part of a beverage syrup supply system, an opening is provided in an end wall of the container to enable release and attachment of a syrup bag spigot. The opening is closed by a slidable closure cover to maintain the integrity of the contents of the container, both before and after release and attachment of the spigot.

A principle object of the invention, therefore, is to provide an improved form of reusable lidded container or box adapted for the shipment and storage of goods, which container is durable and enables effective stacking when the lids are closed, as well as compact nesting when the lids are open.

For a better understanding of the invention, its operating advantages and the specific objectives obtained by its use, reference should be made to the accompanying drawings and description which relate to a preferred embodiment thereof.

DETAILED DESCRIPTION OF A PREFERRED EMBODIMENT OF THE INVENTION

Figure 1:
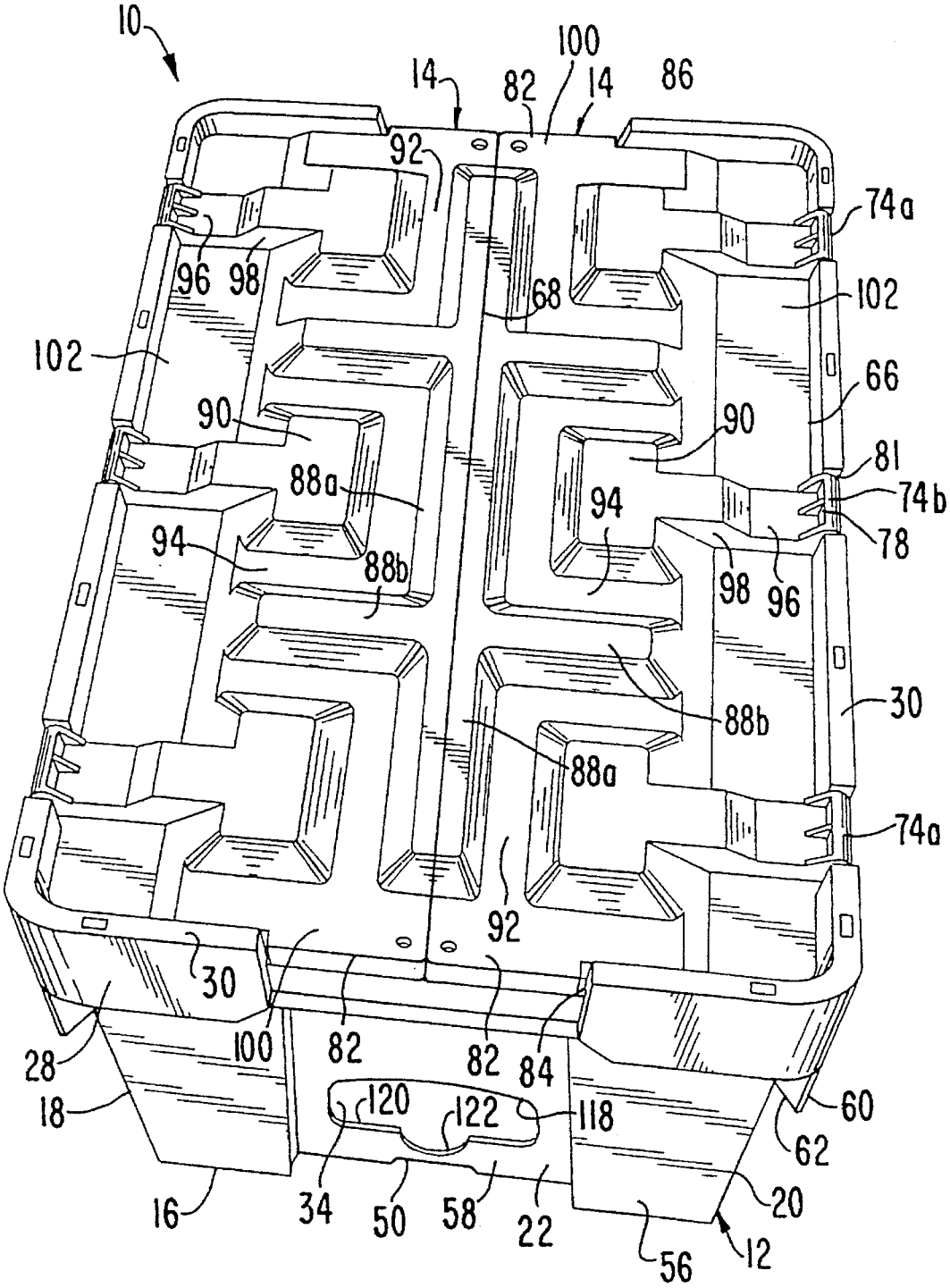
FIG. 1 is a top perspective view of a container assembly according to the invention in a closed condition.

Referring to the drawings, there is shown a container assembly 10 including a container body 12 having opposed pivotable closure lids 14 adapted to enclose the contents of the container body. The parts of the container assembly 10 including the container body 12 and the closure lids 14 may be formed by molding a high density plastic material, such as polyethylene, or the like. The container body 12 contains a generally rectangular bottom 16, upstanding from which are upwardly and outwardly inclined opposed side and end walls 18, 20, 22, and 24 respectively, forming a rectangular top opening 26. Extending about the upper ends of the container walls and defining the top opening 26 is a stiffening pad 28 whose thickness is greater than that of the walls 18 to 24 in order to impart a rigidifying effect. Also, the exterior face of the stiffening pad 28 extends vertically, as contrasted with the inclination of the walls, and terminates in an upwardly facing, generally horizontal rim surface 30. Reenforcing the container body walls in this manner, not only strengthens the structure but, due to the vertical attitude of pad surface, enables the container walls to resist the application of lateral forces that occur during palletizing of the container.

Figure 3:
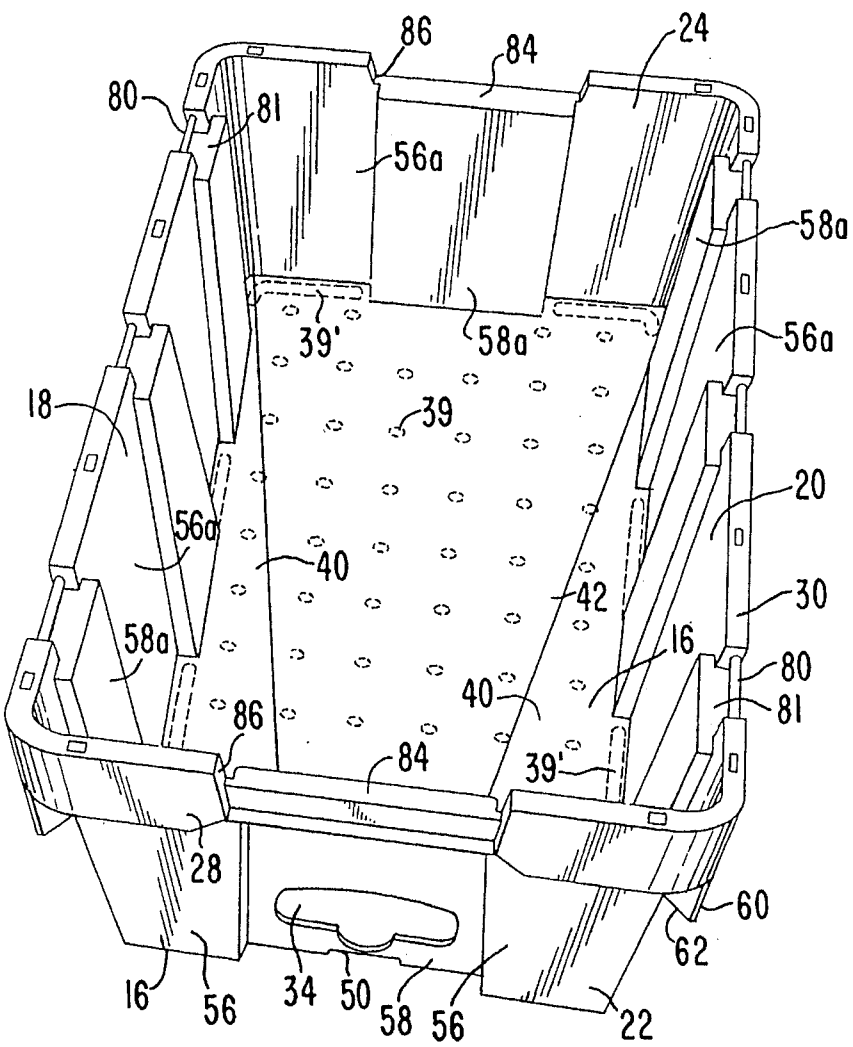
FIG. 3 is a top perspective view, similar to that of FIG. 1 showing the container body with the closure lids removed.
Figure 10:
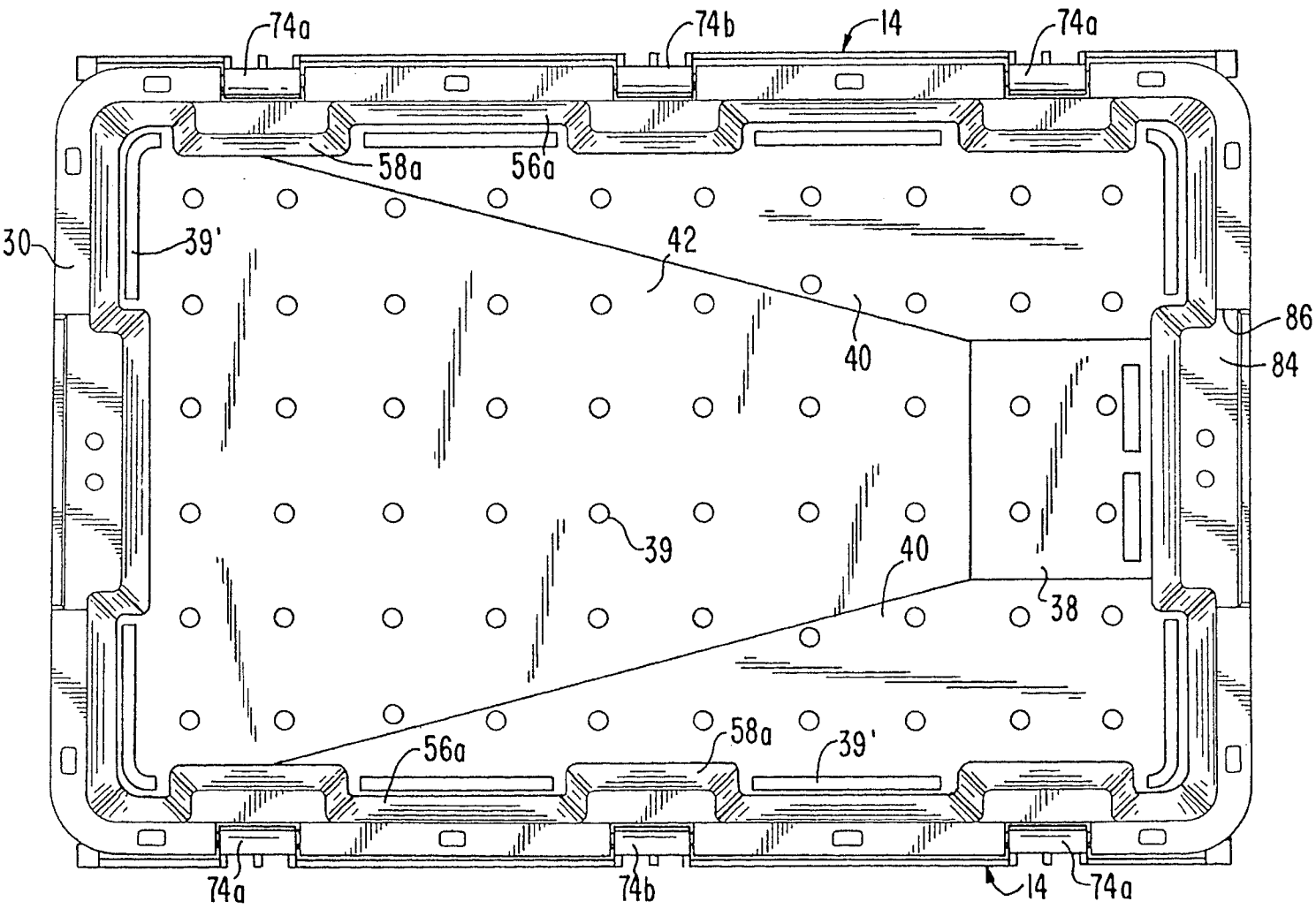
FIG. 10 is a top plan view of the container assembly in an open condition.
Figure 11:
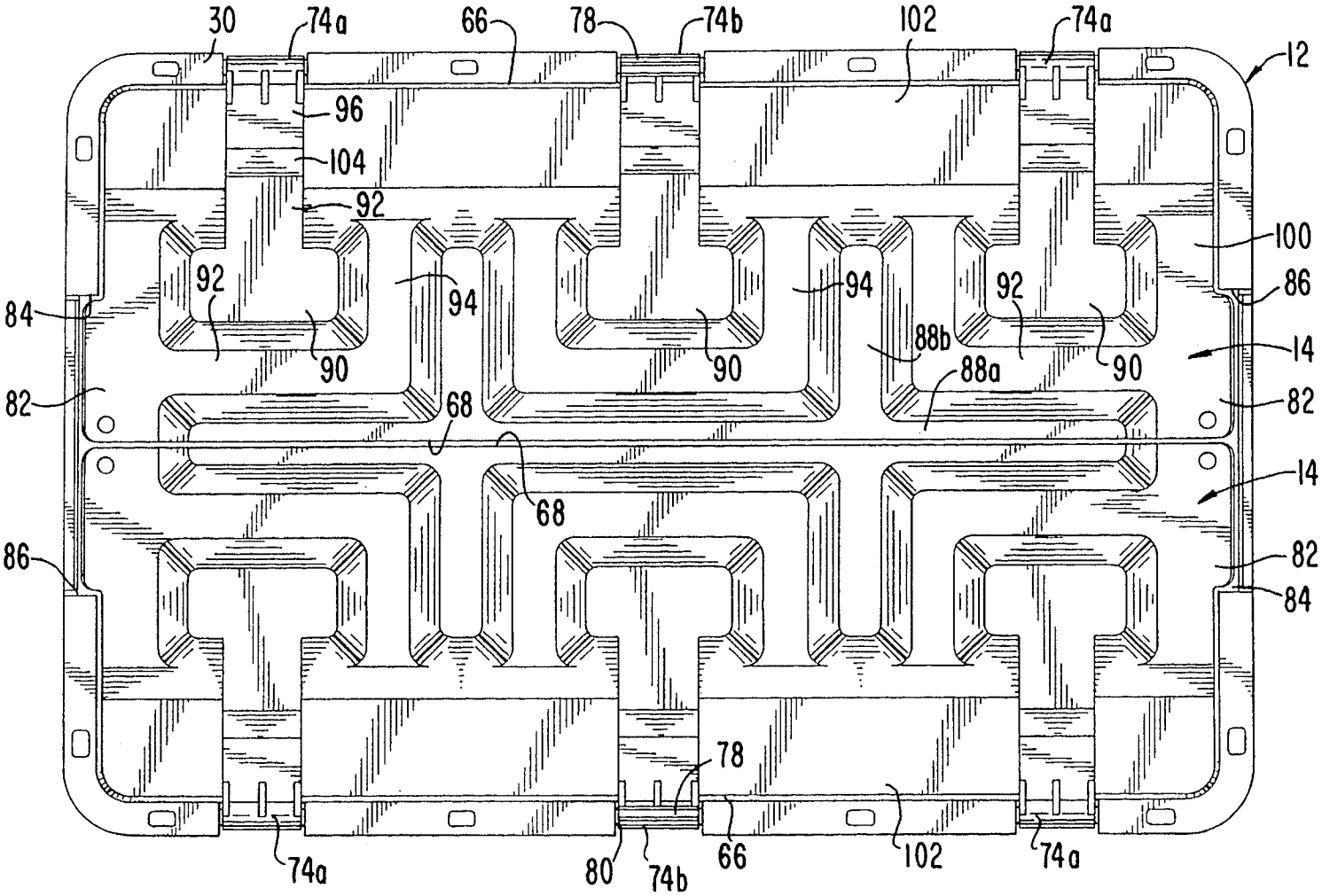
FIG. 11 is a top plan view of the container assembly in a closed condition.

In the described form of container assembly, being one particularly adapted for use in a beverage syrup delivery system, the container body 12 is sized to receive a beverage syrup bag 32 (FIG. 16) and is provided in one end wall, here shown as wall 22, with an opening 34 for release and attachment of a syrup bag spigot 36, as hereinafter more fully described. To facilitate drainage of the bag 32 when the bag is operatively connected in the supply system, the container body bottom 16 is preferably configured to incline the bag 32 toward the opening 34. Thus, as shown best in FIGS. 3, 10 and 15, the bottom 16 contains a generally horizontal portion 38 adjacent the opening 34. Opposed side portions 40 of the bottom 16 contain a relative steep lateral incline of about eight degrees extending downwardly toward the horizontal portion 38. The predominant, intermediate portion 42 of the bottom 16 is inclined longitudinally toward the portion 38 at about a two degree slope. Thus, the contents of a syrup bag 32 housed within the container body will be pitched toward the end opening 34 to gravitationally induce flow from the bag when the spigot 36 is in place on the opening and activated to an open condition. Advantageously, the bottom surface 16 may be provided with a plurality of small diameter holes 39 to permit the discharge of any spillage from the interior of the container.

Figure 12:
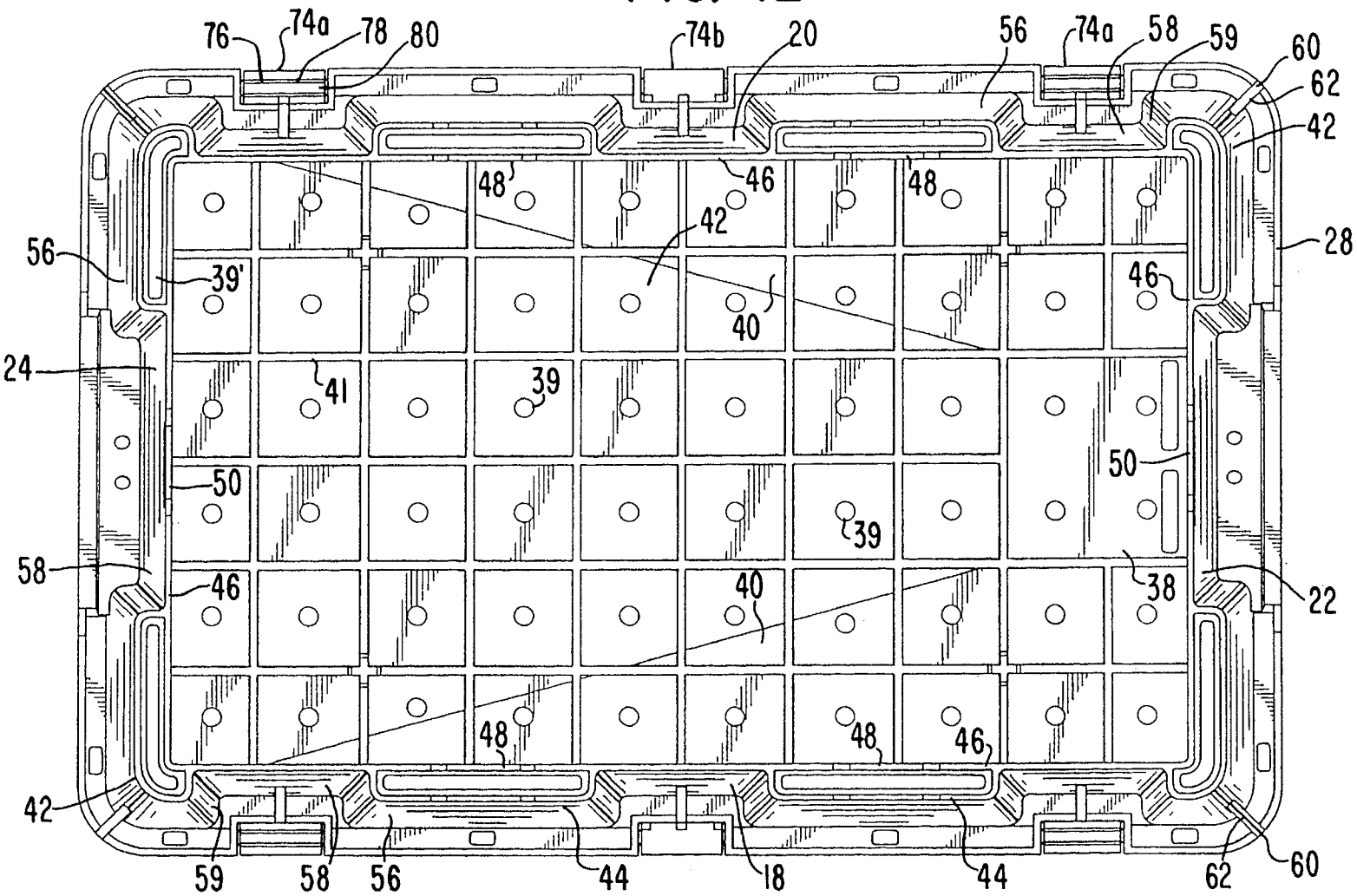
FIG. 12 is a bottom plan view of the container assembly in a closed condition.
Figure 13:
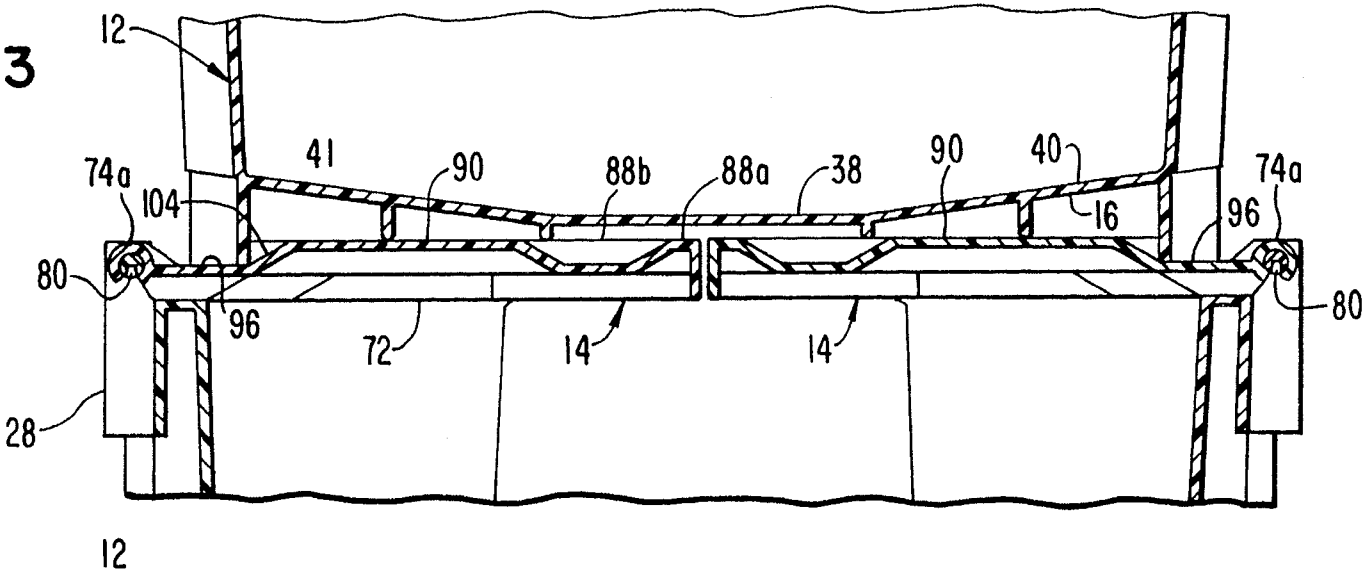
FIG. 13 is a partial sectional elevational view of a container assembly of the invention in a closed condition and having a superposed container body stacked thereupon.

The underside of the container bottom 16 may, as shown in FIG. 12, be provided with a reenforcing grid 41 to increase the strength of the structure forming the bottom. Also provided are a plurality of formed feet 42 and 44 that are disposed in a generally rectangular array and connected by a substantially continuous rib 46 about the periphery of the container bottom. As shown, the feet are each double-walled members with the spaces between the walls of the respective members being such as to cooperate with a container-positioning channel system, as hereinafter more fully described. Those feet indicated as 42 and disposed at the corners of the container bottom have uninterrupted base edges, while those indicated as 44 and positioned at spaced locations along the longitudinal sides of the bottom have base edges that are interrupted by recesses 48 formed therein for cooperation with the channel system hereinafter described. Recesses 50, similar in form and purpose to the recesses 48, are provided at the midportion of the rib underlying the end walls 22 and 24. Elongated openings, indicated as 39', conform generally to the sectional shape of the feet and supplement the function of the circular holes 39 for removal of spillage from the interior of the container body 12.

The external surfaces of the walls 18 to 24 of the container body 12 contain alternating projection and recessed portions, indicated as 56 and 58 respectively, with the intermediate recessive edges 59 being upwardly convergent. Conversely, the interior surface of the container body 12, represented by the opposite faces of the respective portions 56 and 58, define oppositely directed surface portions indicated as 56*a* and 58*a* respectively. Thus the wall portions forming the projections 56 on the exterior surface of the container body 12 forms recesses 56*a* on the interior surface thereof. Similarly, the recessed wall portions 58 on the exterior surface form projections 58*a* on the interior surface. Such a configuration of the walls, it will be appreciated, permits the projections 56 on the exterior surface of a superposed container body 12 to be received in the correspondingly positioned recess 56*a* on the interior surface of the subjacent container body when the container assemblies are internested. In this way lateral and longitudinal movement between the nested assemblies is restricted.

In order to limit the extent to which adjacent container bodies 12 are permitted to extend into a subjacent container body, positioning ribs 60 are disposed at the corners formed by the intersecting walls of the container body. The ribs 60 depend from the lower end of the stiffening pad 28 and present a shoulder 62 for engagement with the rim surface 30 of the subjacent container body 12, thus to prevent the container bodies from being excessively forced together under the weight of a large number of nested assemblies.

Figure 4:
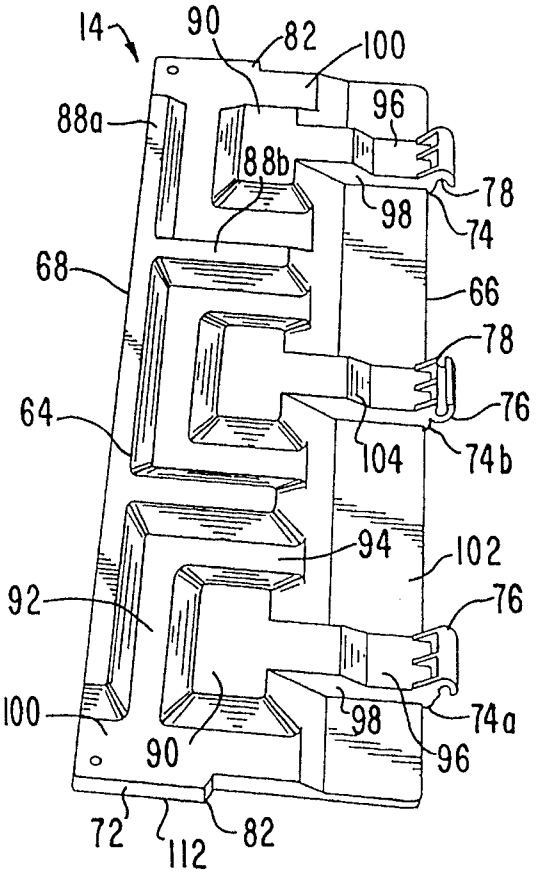
FIG. 4 is a top perspective view of a closure lid.
Figure 9:
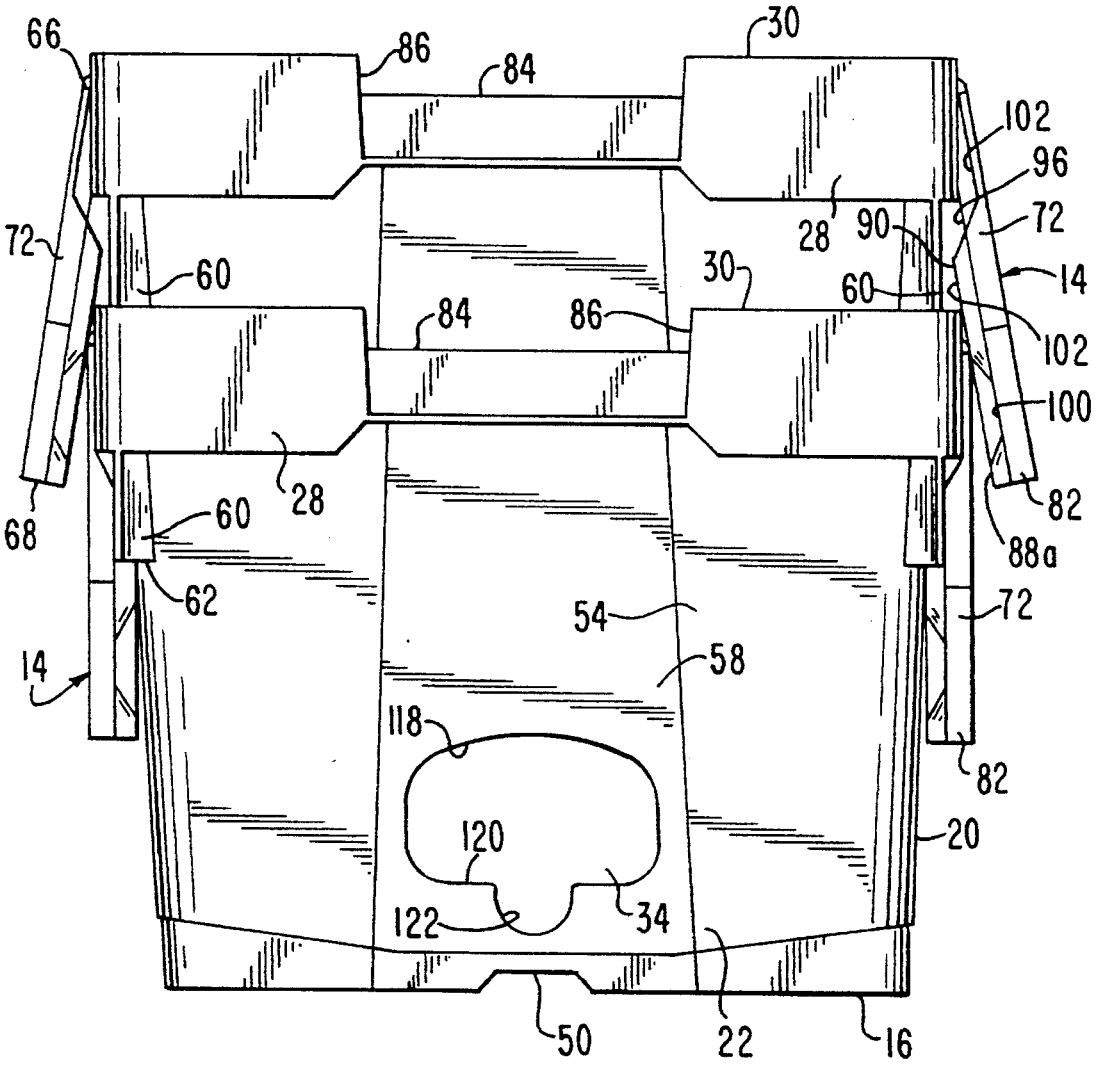
FIG. 9 is an elevational view similar to FIG. 7 showing the container assemblies nested in an open condition.
Figure 15:
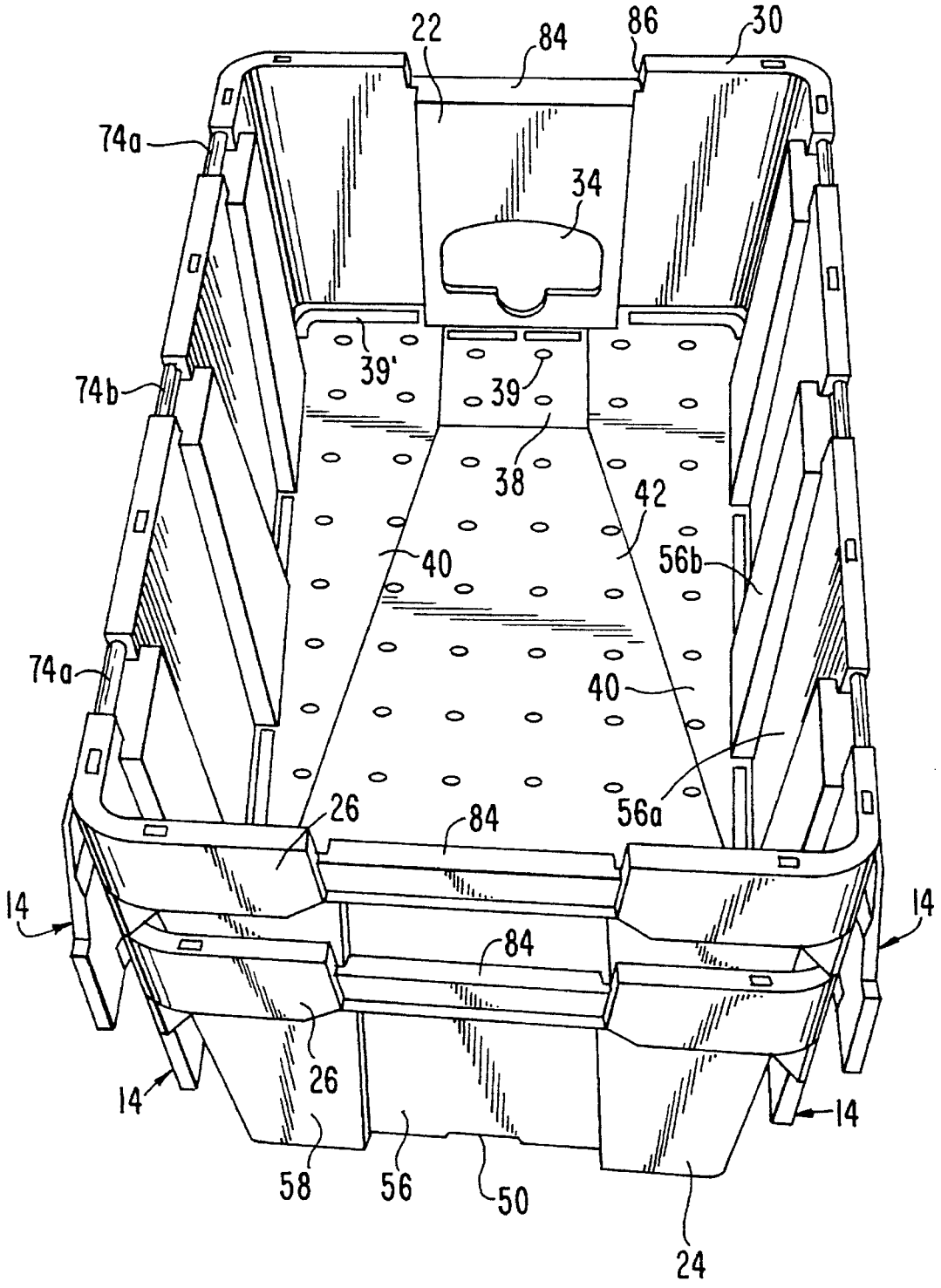
FIG. 15 is a top perspective view of a pair of nested container assemblies.

According to the invention, the top opening 26 of the container body 12 is closed by a pair of opposed closure lids 14, a typical one of which is shown in FIG. 4. As shown best in FIG. 1, the closure lids 14 have a particularly contoured exterior surface that not only rigidities the relatively thin-walled structures but also serves to define a positioning system that enables container assemblies to be vertically stacked for use in a beverage supply system, as shown in FIGS. 9 and 15, as well as to be cross-stacked on pallets during storage and shipment, as illustrated in the diagrammatical representation of FIG. 19. The structural configuration of the lids 14 is such also to advantageously enable the lids, when in an open condition for nesting of the container bodies, to be closely spaced to the shingled lids of adjacent container bodies so as to present a compact nested structure. Also, the hinge structure employed in connecting the lids 14 to the container body 12 is arranged to enable each lid to remain connected to the container body during normal use but to permit release of a lid from the connection when an extraordinary force is imposed on the lid, thus to protect the container body from damage by the imposition of the force.

Figure 2:
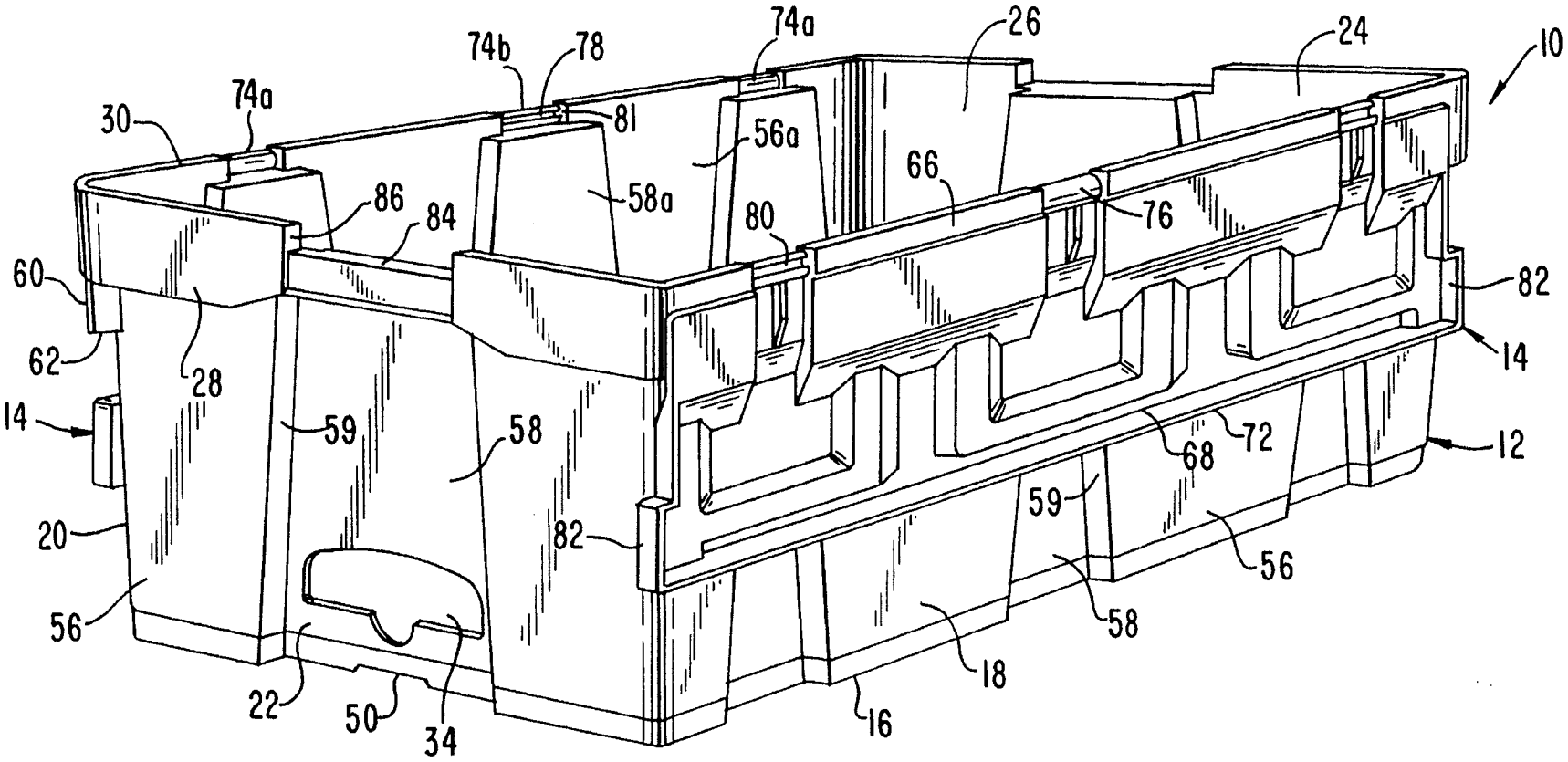
FIG. 2 is a side perspective view of the container assembly of FIG. 1 shown in an open condition.
Figure 14:
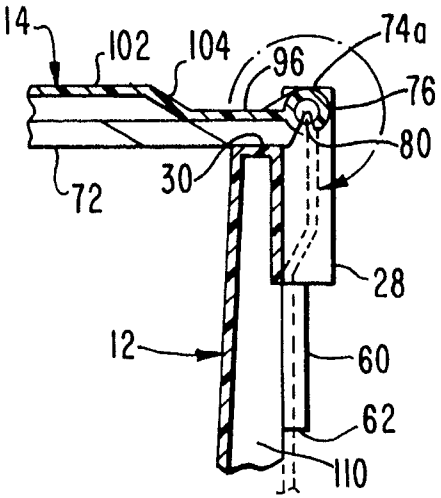
FIG. 14 is a partial sectional view of a container assembly illustrating the closure lid in both its open and its closed position.

With particular reference to FIG. 4, therefore, each lid member 14 comprises a generally rectangular body 64 whose periphery is defined by a longitudinally extending hinge edge 66, and opposed median edge 68, and opposed side edges 70. The hinge edge 66 contains three hinge elements 74, with the outermost elements, indicated in the drawing figure as 74*a*, containing a hinge sleeve or knuckle 76 having a longitudinal slit 78 which faces the interior the interior plate body surface (see FIG. 2) while the intermediate dement 74*b* has the slit on its knuckle diametrically displaced to face the exterior surface of the plate. The hinge elements 74*a* and 74*b* on the lid 14 are adapted to engage hinge pins 80 that are installed in recesses 81 formed in the stiffening pad 28 along the upper end of the side walls 18 and 20. Connection of the hinge elements 74*a* and 74*b* to the respective pins 80 is facilitated by the resiliency created in the wall of the respective knuckles 76 by the presence of the slits 78. Thus, the respective knuckles 76 are installed on the pins 80 by extending each knuckle wall about the associated pin. For reasons explained hereinafter, the hinge arrangement, in cooperation with the structural configuration of the container body 12, enables the lid 14, as shown in FIG. 14, to be rotated about 270 degrees from a horizontal position extending across the container top opening 26, when in a closed condition, to a substantially vertical position when opened. Each lid 14, due to the cooperation between side edge extensions 82 and the support surface 84 formed by recesses 86 in the end walls 22 and 24, permit each lid to be simply supported between the hinge connections 74*a* and 74*b* along one edge and the supported engagement between extensions 82 and surfaces 84 adjacent the opposed median edge 68.

Due to the alternating orientation of the weakened portion of the respective knuckles 76 created by the slits 78, it will be appreciated that the overall strength of the hinge connections is such as will enable each lid 14 to be securely connected to the container body 12 under all but extraordinary conditions of stress. When subjected to inordinate stress forces, as may occur during periods of movement of the containers, the totality of the hinge connection is, however, sufficiently weak to permit the connection to be broken to release the lid from the container body thereby preventing any resultant damage to be inflicted on the more costly container body.

Figure 17:
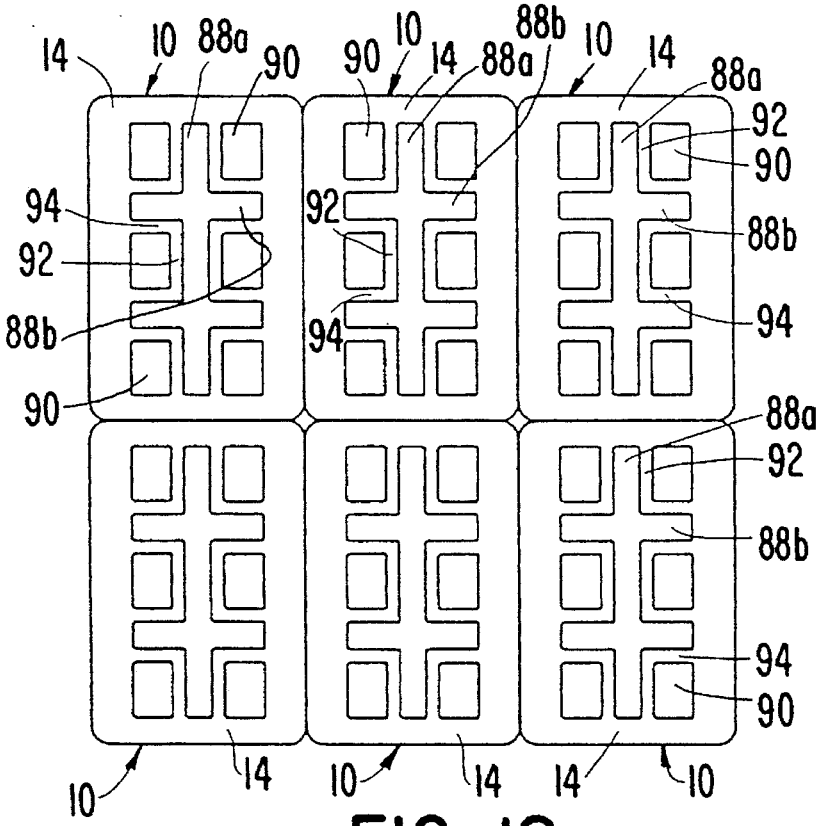
FIG. 17 is a top plan schematic representation of a layer of container assemblies arranged, as for example, on a pallet.

The exterior surface of the lid 14 is formed with a plurality of raised portions 88 and 90 that are so configured and positioned with respect to one another as to provide a channel system which includes rectangularly arranged longitudinally and laterally-extending channels 92 and 94 respectively, for receiving projecting feet elements 42 and 44 of the underlying rib structure of superposed container bodies 12 to effect cross-stacking of the containers, as hereinafter more fully described. Thus, the lid 14 contains a longitudinally extending raised portion 88*a* having a pair of angularly offset arms 88*b* dividing the portion 88*a* into three sections of approximately equal length. The spaces enclosed by the portions 88*a* and 88*b* each contain the portions 90 that are each uniformly spaced about its sides that face the portions 88*a* and 88*b* to define the channels 92 and 94. The raised portion 88*a* extends flush with the median edge 68 of the lid 14 and has a width dimension approximately half that of the portions 88*b*. The result is that, when a pair of lids 14 are disposed in a closed condition across the top opening 26 of the container body 12, there is defined, as shown in FIGS. 1 and 17, a channel system that is bilaterally symmetrical and that has a length to width ratio of about 3 to 2.

Figure 18:
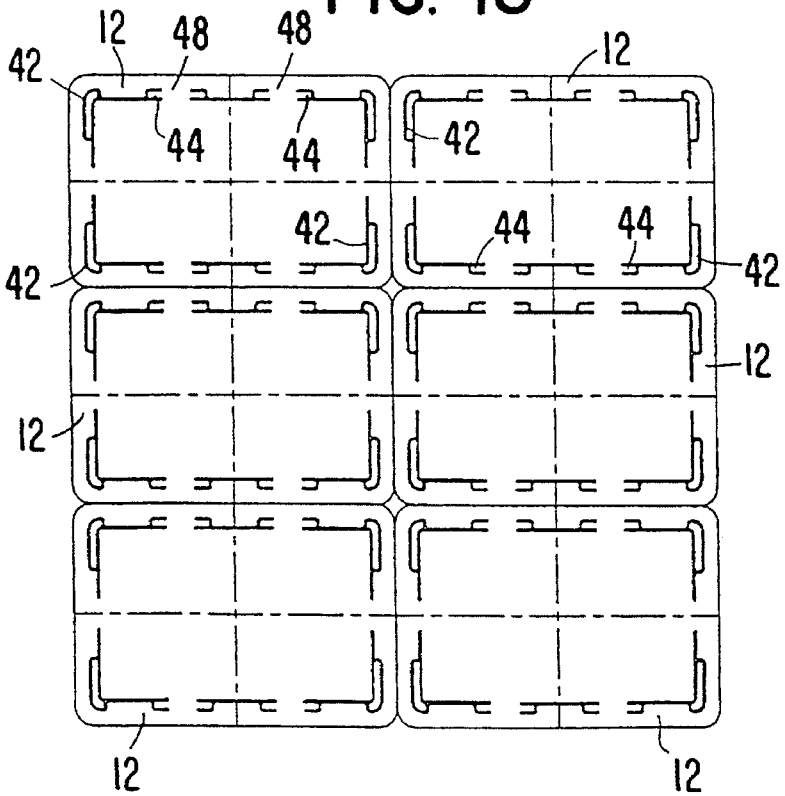
FIG. 18 is a bottom plan schematic representation of the container assembly in FIG. 17.
Figure 19:
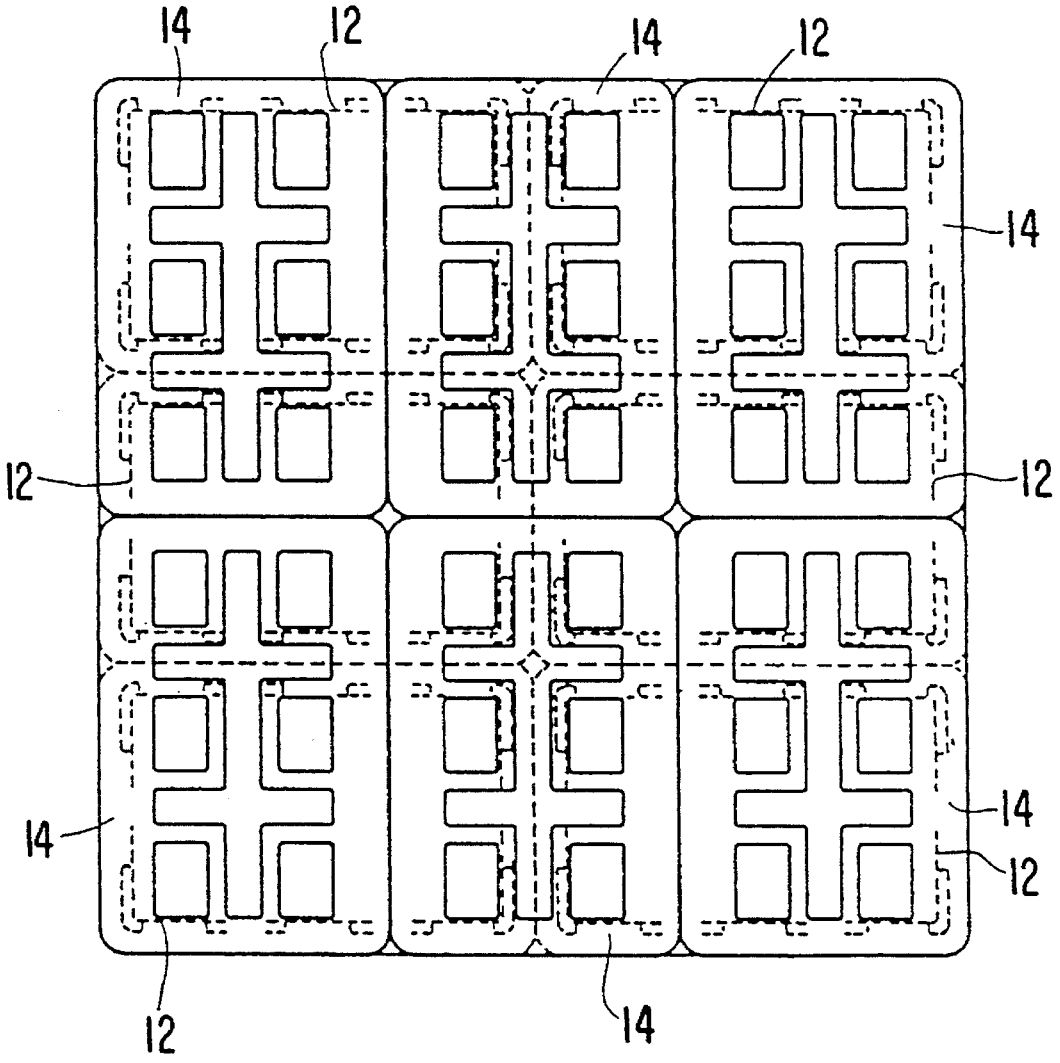
FIG. 19 is a diagrammatic representation illustrating the cross-stacking of layers of container assemblies.

The channel system has particular utility when the container assemblies 10 are arranged for cross-stacking on a pallet, as explained with reference to FIGS. 17, 18 and 19. FIG. 17 is a diagrammatic representation of the channel system produced by a layer of container assemblies positioned on a pallet comprising two laterally extending rows, each containing three assemblies. FIG. 18, on the other hand, is a diagram representing the rib pattern on the underside of a similar number of container bodies 12 particularly showing the position of the feet 42 and 44 and the recesses 48 and 50 when the container bodies are arranged for cross-stacking upon the layer of FIG. 17. The resultant disposition of the rib pattern of FIG. 18 as received in the channel system of FIG. 17, is diagrammatically shown in FIG. 19 where certain of the feet 42 and 44 are received in the channels 92 and 94 with their positions automatically determined by the cooperative engagement between the recesses 48 and 50 of the rib structure and the raised portions 88.

Figure 16:
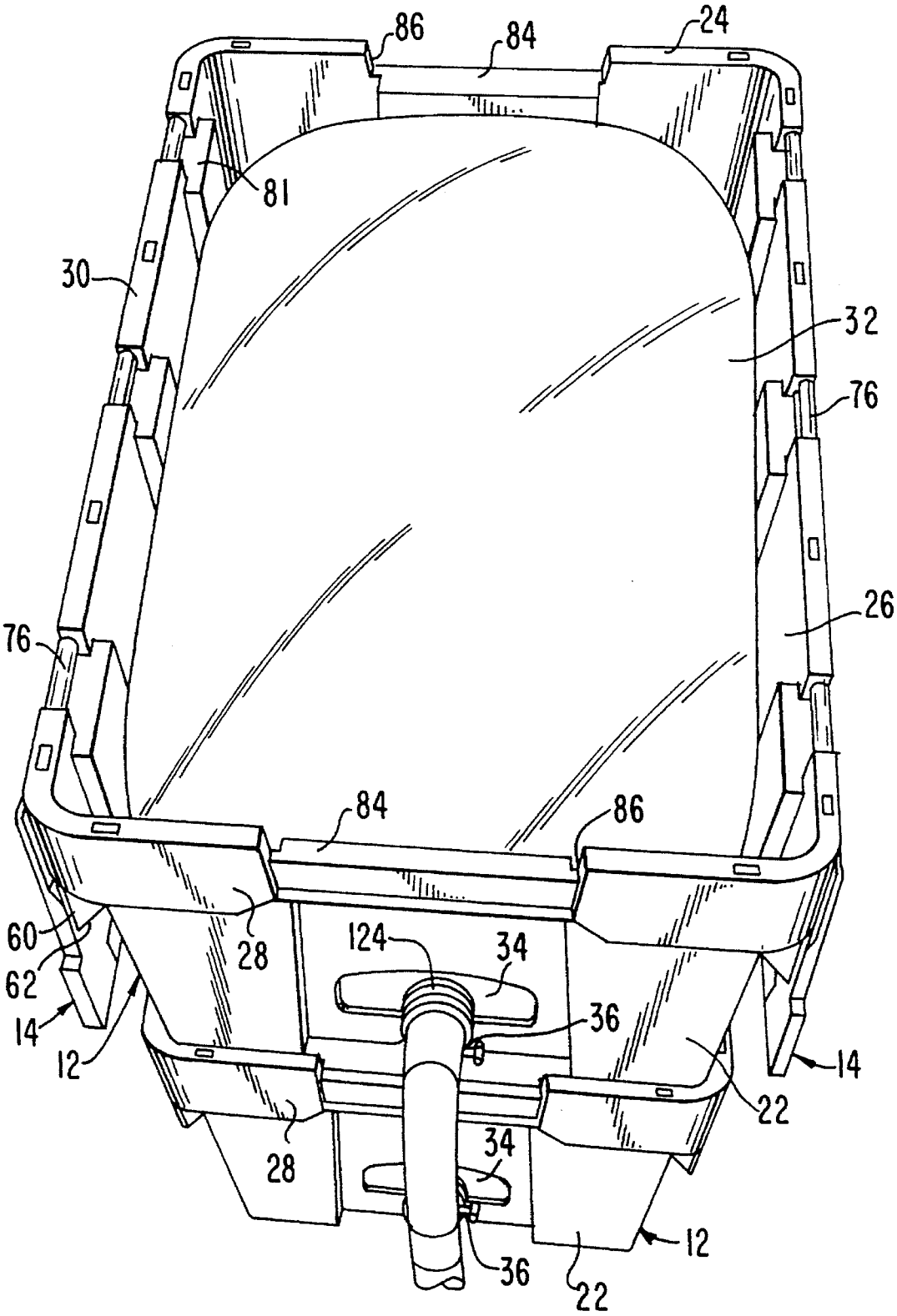
FIG. 16 is a top perspective view of a pair of stacked container assemblies with the upper container body open and the lower container body closed.

For stacking the container assemblies 10 in an aligned column, as is required when they form part of a beverage distribution supply system as shown in FIG. 16, the underlying rib structure is caused to sit on the lower levels 96 of a stepped box-section 98 that extends between the raised portions 88 of the lids 14 and the hinge elements 74*a* and 74*b*. As shown in FIG. 1, the surface of the lower level 96 on each box-section 98 is in coplanar relation with the end portions 100 of the lid bodies 64. Thus, a superposed container body 12 can be supported at a uniform level about its periphery with relative lateral movement between the stacked containers being restricted by the cooperation between the raised portions of the box-sections 98 on the lids 14 of the subjacent container assembly 10 and the underlying rib structure of a stacked container body 12. Longitudinal movement between the stacked containers is restricted by the cooperation between the ends of the raised portions 88 and 90 on the lids 14 with the adjacent rib structure of the stacked container body.

Figure 5:
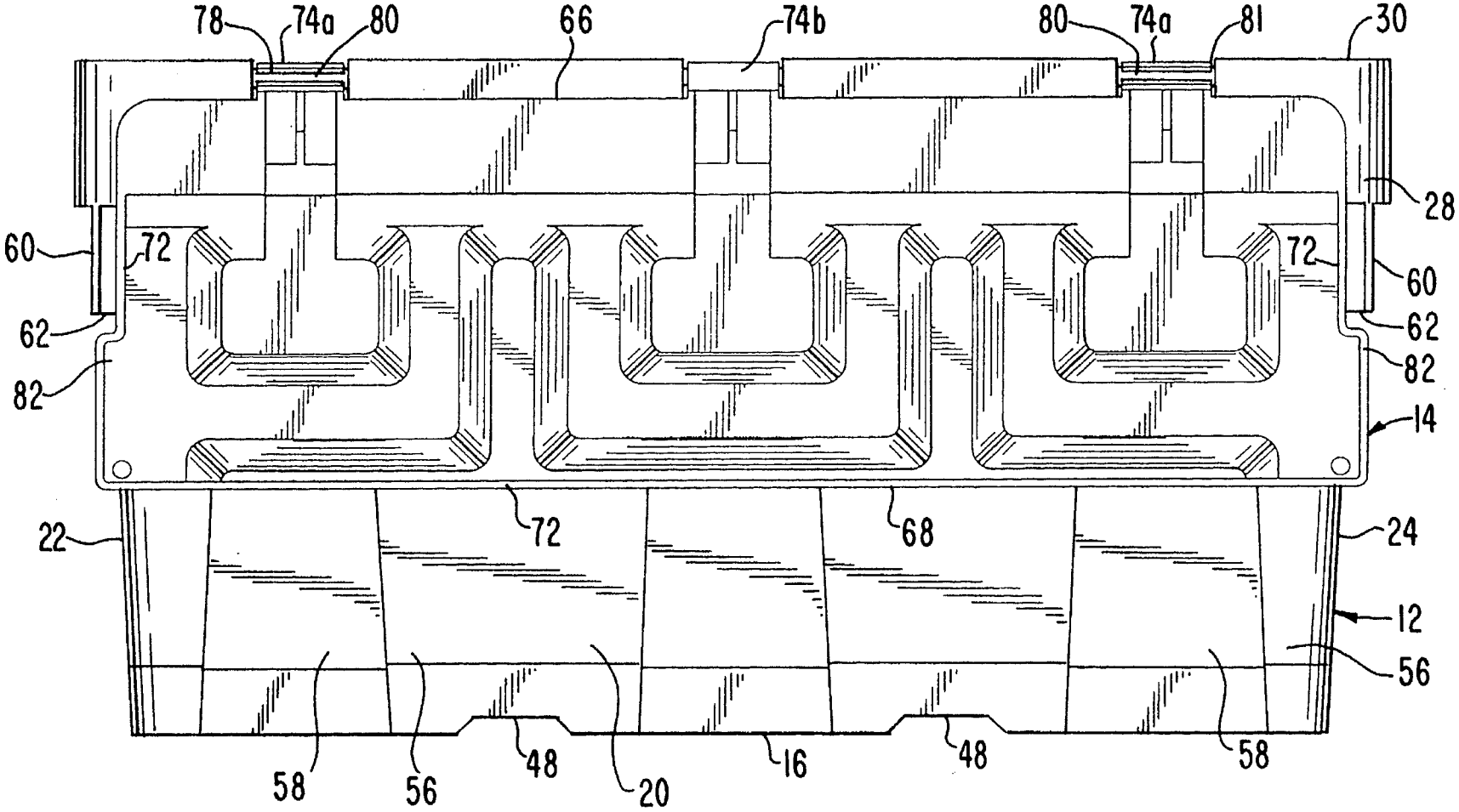
FIG. 5 is a side elevational view of the container assembly of FIG. 1 in an open condition.
Figure 6:
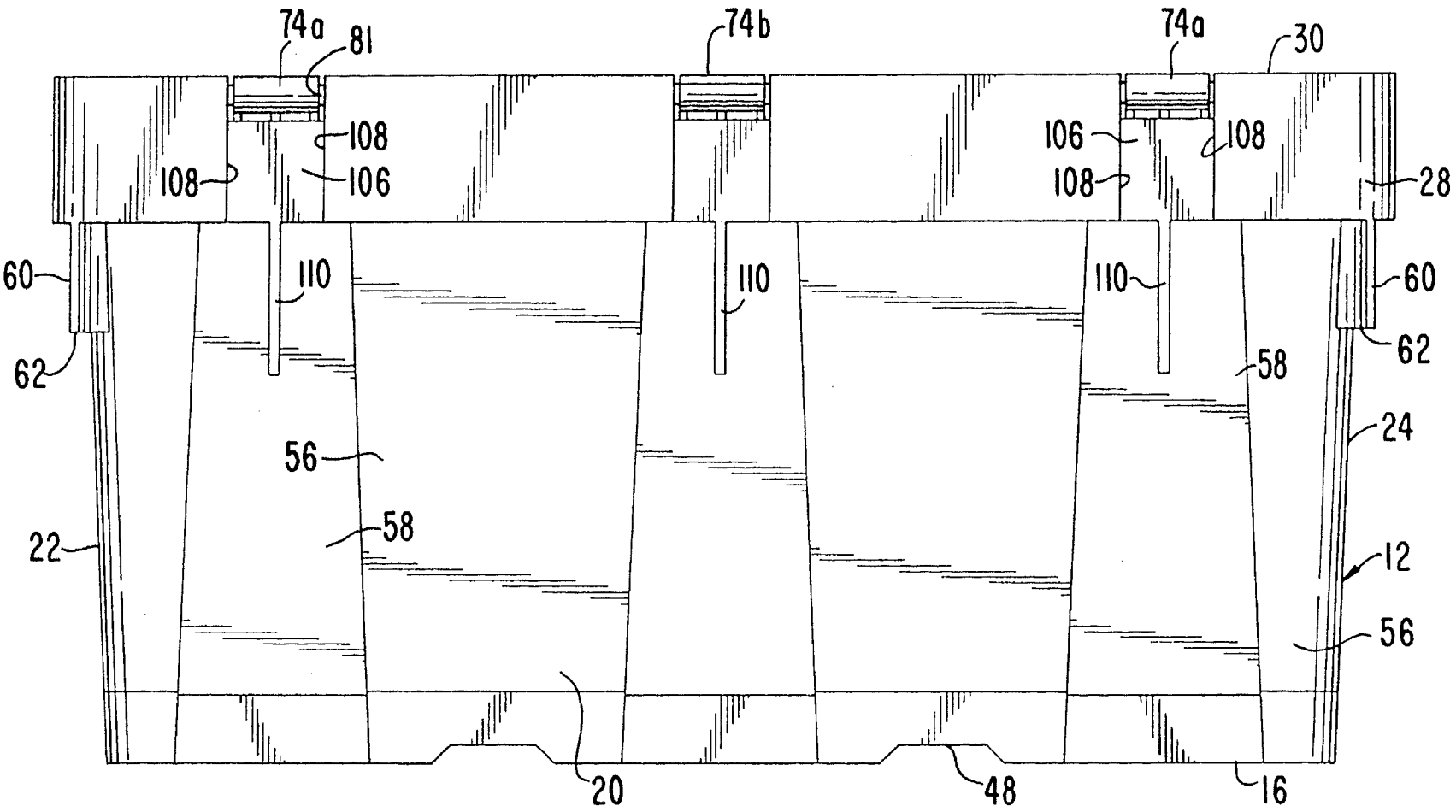
FIG. 6 is a side elevational view, similar to that of FIG. 5, showing the container assembly in a closed condition.
Figure 7:
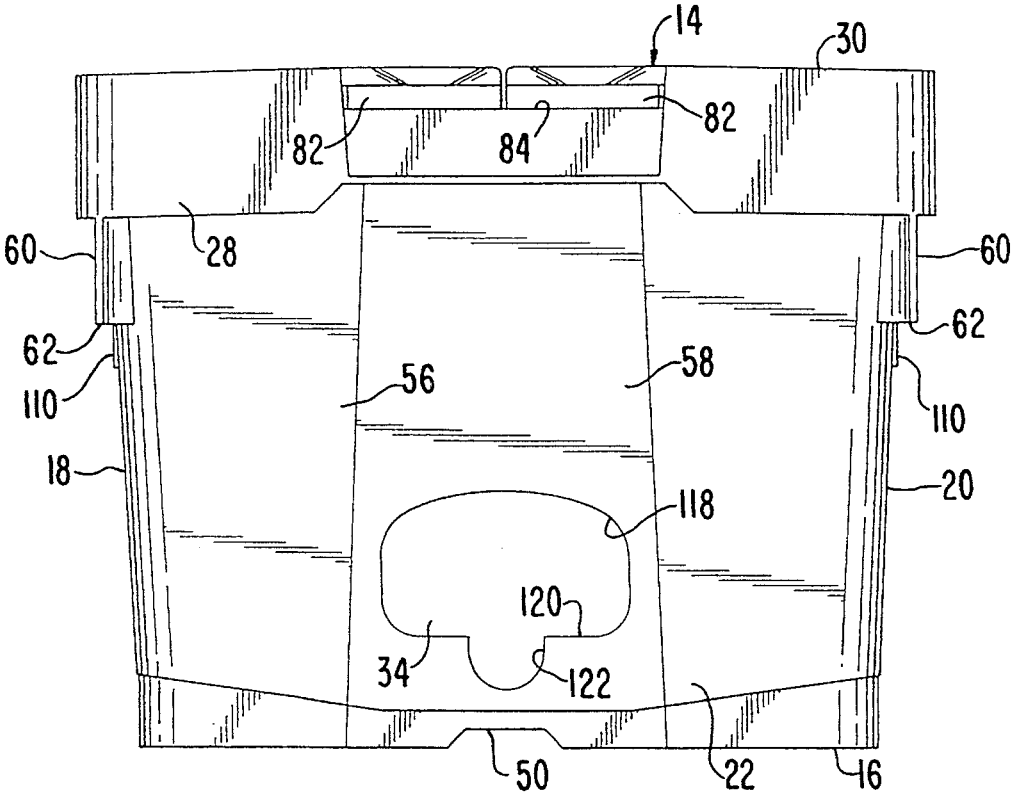
FIG. 7 is an elevational view of one end of the container assembly shown in a closed condition.
Figure 8:
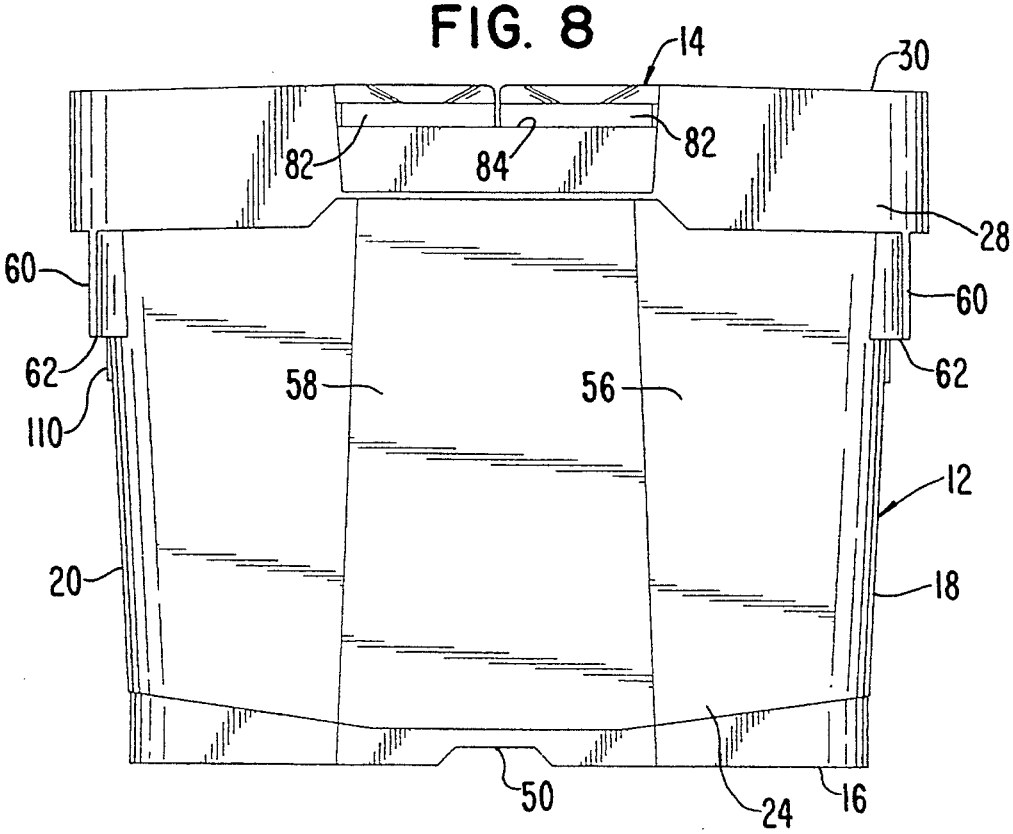
FIG. 8 is an elevational view of the other end of the container assembly shown in a closed condition.

The container assembly 10 incorporates elements of design that are contemplated to reduce the lateral flare of the lids during nesting of the container bodies 12 when the lids 14 are disposed in an open condition. Thus, with particular reference to FIGS. 4, 5 and 6, it can be seen that the lid body, exclusive of the raised portions 88 and 90 and the box sections 98, is formed on its exterior with a stepped configuration containing two horizontal levels. One level is represented by the plane of the channels 92 and 94 and end portions 100. The other level, indicated as 102, is offset from the one level and joined thereto by the transition section 104. The level 102 is sized and configured to receive the stiffening pad 28 of the container body 12 when the lid 14 is in its open condition. To accommodate the box sections 98 that stiffen the respective hinge elements the stiffening pad 28 contains recesses 106 which extend part-way through the thickness of the stiffening pad and are provided with vertical sides 108 to permit reception of the box sections 98. As shown, a rib 110 depends from the underside of stiffening pad 28 within each recess 106. These ribs 110 are arranged to engage the facing surface of the raised portions 90 and thereby provide lateral support for the lid 14 in its open condition against the container body 12.

Notwithstanding the irregular configuration of the exterior of the lid 14, as seen in FIG. 1 there is provided on the opposite side of the lid a continuous, coplanar support surface defined by the bottom edge 112 of the stiffening skirt 72 and the opposite face 114 of the level 102 to insure stable engagement between the lid 14 and the container body 12 when the lid is in a closed condition.

Thus, as can be appreciated from a consideration of FIGS. 9 and 15, the lids 14, when opened for nesting of the container bodies 12, project only minimally in the lateral direction from the side of the container body. This is due in part to the fact that, when the lids 14 are laterally supported by the engagement between the external surface of the raised portions 90 and the respective ribs 110, the box sections 98 on the lid are received in the recesses 106 in the stiffening pad 28 on the container body 12 and the stiffening pad 28, in turn, is received in the recess formed by the offset surface of lid level 102 and the transition surface 104. Also, with the lid 14 in this condition, the raised portion 88 at the lower end of the exterior lid surface can be readily accommodated within the space created by the tapered configuration of the container body side walls 18 and 20. Furthermore, engagement between the raised portions 90 and ribs 110 insures that the edge 112 of the lid 14 will be substantially parallel to the vertical surface of the stiffening pad 28.

Figure 20:
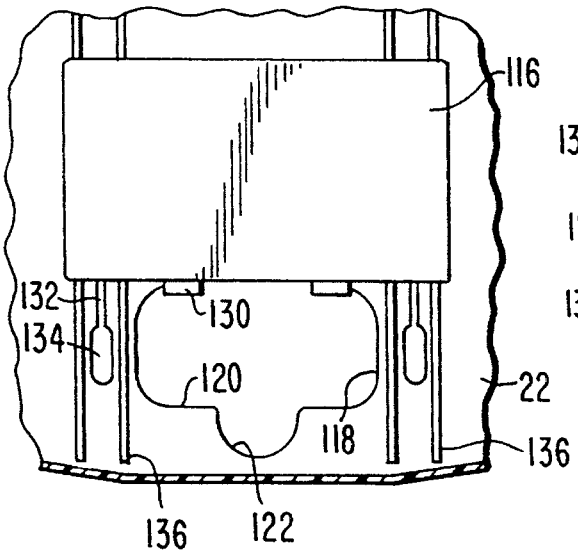
FIG. 20 is a partial elevational view of the interior side of the container body end wall illustrating the closure cover in its open position with respect to the spigot opening.
Figure 21:
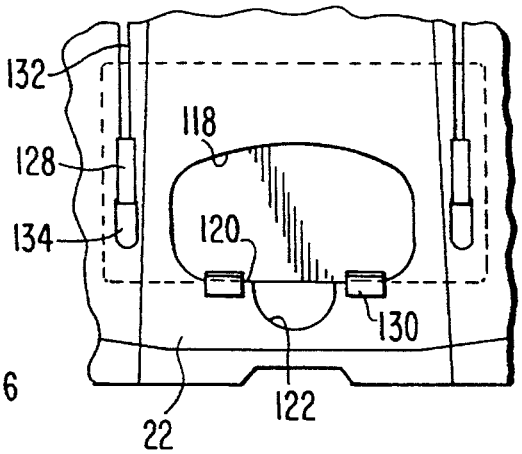
FIG. 21 is a partial elevational view of the exterior side of the container body end wall illustrating the closure cover in its closed position with respect to the spigot opening.
Figure 22:
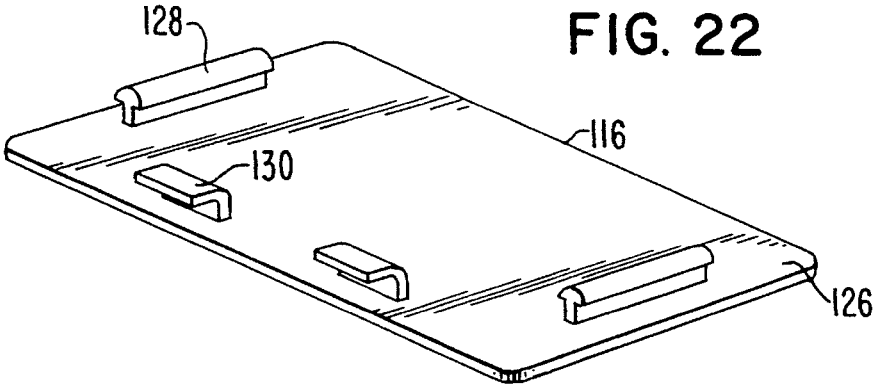
FIG. 22 is a perspective view of a disassembled spigot opening closure cover.

FIGS. 20 through 24 illustrate various embodiments of end wall opening arrangements enabling release and attachment of the spigot 36 of a beverage syrup bag 32 housed in the container assembly 10 for a syrup supply system. FIGS. 20 through 22 illustrate an end wall opening corresponding to that shown at 34 in FIGS. 1 to 3 but in which a slidable closure plate 116 is employed to selectively cover or expose the opening. The opening 34 comprises an enlarged portion 118 that is adequately sized to enable access by a workman to the interior of the container body 12 in order to release the spigot 36 from bag 32. The bottom of the opening 34 is defined by a substantially straight horizontal edge 120 having a depending recess 122 into which an annular slot 124 formed on the spigot 36 is inserted in order to operatively attach the spigot to the container body 12.

The closure plate 116 is shown in perspective in FIG. 22. As shown, the plate comprises in general a rectangular body 126 that is slightly flexible in the plane of the plate and having a length and width adequate to cover at least the enlarged portion 118 of the opening 34. Adjacent the respective lateral side edges of the plate 116 are disposed oppositely spaced, elongated, headed lugs 128 extending from the plate surface. Projecting from the same surface of the plate body 126 are a pair of angularly offset stops 130 that are each disposed to engage the lower edge 120 of the opening 34 on opposite sides of recess 122.

In order to accommodate the closure plate 116, the end wall 22 of the container body 12 is provided with a pair of parallel slots 132 disposed each on opposite sides of the opening 34. At their lower ends the slots 132 each contain an enlarged opening 134 to enable passage of the heads on the respective lugs 128 in order to enable attachment of the plate to the container end wall 22. The closure plate 116 is frictionally retained on the end wall via flex ribs 136 positioned on opposite sides of the respective slots 132. The ribs 136 may be arcuate in profile shape or be formed with an inclined planar shape so as to flex the plate to place the heads of the lugs 128 into frictional engagement with the container end wall.

In use, the closure plate 116, once assembled to the container end wall 22, is arranged to remain in overlying relation with respect to the opening 34 with the angular stops 130 in engagement with the edge 120 of the opening leaving the recess 122 uncovered. To install the beverage syrup bag 32 into the supply system like that shown in FIG. 16, the plate 116 is manually raised, the spigot 36 released from the interior of the container and attached to the recess 122, and the plate thereafter lowered until it engages the spigot to thus reduce access to the bag from the exterior and increase the degree to which it is protected against damage.

Figure 23:
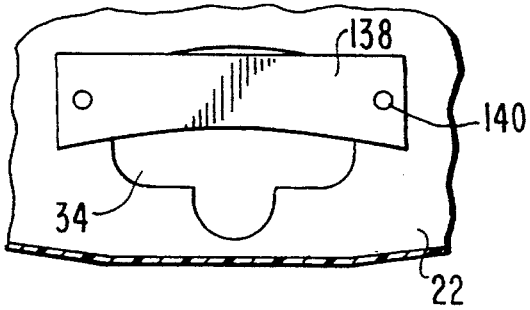
FIG. 23 is a partial perspective view showing an alternate form of closure for the spigot opening.

FIG. 23 shows an alternative form of closure in which the plate 116 is replaced by a strap 138 formed of thin walled, flexible material, such as an elastomer, that is slotted for releasable reception and headed studs 140 fixedly secured to the container end wall 22.

Figure 24:
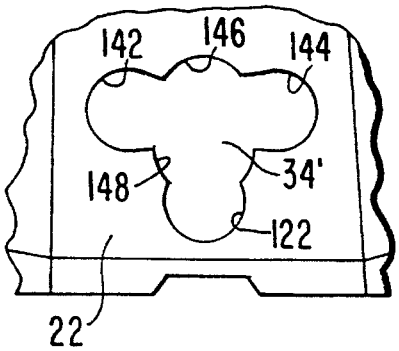
FIG. 24 is an elevational view of an alternate form of spigot opening.

FIG. 24 illustrates an opening arrangement indicated generally as 34' that utilizes no closure plate. In this arrangement the opening of greater size above the recess 122 is formed by four, generally arcuate openings 142, 144, 146 and 148, each of a size which is less than that required to enable passage of the spigot 36, except at the intersection of the smaller openings through which the spigot can pass for attachment to the recess 122.

While the description herein pertains to a preferred embodiment of the invention, it should be understood that various changes in the details, material and arrangement of parts which have been described and illustrated in order to explain the nature of the invention, may be made by those skilled in the art within the principle and scope of the invention as expressed in the appended claims.

What is claimed is:

1. A container adapted to form part of a fluid delivery system, comprising:

a generally rectangular bottom;

rectangularly arranged opposed side and end walls extending upwardly from said bottom;

an access aperture formed in one of said end walls for access to a spigot on a fluid-filled bag positioned within said container, said access aperture includes an enlarged portion, an edge forming a lower side of said enlarged portion having a depending recess configured to receive said spigot when in its operative position;

a closure plate mounted on said one of said end walls to close said access aperture, and elongated slots on opposite sides of said access aperture and lugs on a surface of said closure plate for reception in said slots, said lugs being slidably movable within said slots for movement between said overlying and remote positions of said closure plate, said closure plate also including shoulder means formed on said closure plate adapted to engage said lower side of said enlarged portion of said access aperture to maintain said closure plate elevated above said depending recess when said closure plate is in its closed position; and mounting means for mounting said closure plate for movement between a position overlying said access aperture and a position remote therefrom whereby said aperture means can be selectively opened and closed.

2. A container assembly adapted to form part of a fluid delivery system comprising:

an open-topped container body including a generally rectangular bottom and rectangularly arranged opposed side and end walls extending upwardly from said bottom, a pair of opposed lid members each having a side edge pivotally secured to a respective upper end of one of said opposed side walls for pivotal movement between a generally horizontal position closing the top of said container body and an open condition in which each said lid member is generally vertically disposed in close proximity to the respective opposed side wall to which its side edge is pivotally secured, and at least one side wall hinge element on each of said opposed side walls and at least one cooperating lid member hinge element on each of said lid members for operative engagement therewith, wherein each of said lid members includes a generally flat region adjacent said side edge, each of said lid members also having a box section adjacent each lid member hinge element thereon, each said box section extending substantially perpendicular to said side edge and each said box section providing stiffening to a respective lid member hinge element, wherein each of said opposed side walls includes a side wall recess adjacent each side wall hinge element thereon, each said side wall recess disposed and sized to receive the box section of a respective lid member when said respective lid member is in an open condition, wherein said container body has an aperture means formed in one of said opposed end walls, said aperture means forming an opening for access to a spigot on a fluid-filled bag deposited in said container assembly, wherein said container body further has a closure plate mounted on said one of said opposed end walls to close said aperture means, said container body also having a means for mounting said closure plate for movement between a position overlying said aperture means and a position remote therefrom whereby said aperture means can be selectively opened and closed, and further wherein said container body also includes elongated slots on opposite sides of said aperture means and lugs on a surface of said closure plate for reception in said slots, said lugs being slidably movable within said slots for movement between said overlying and remote positions of said closure plate.

3. The container assembly according to claim 2 in which said container body includes a stiffening pad about the tops of said side and end walls, each said side wall recess being formed in said stiffening pad adjacent a respective side wall hinge element, and each said box section and each said lid member having a downwardly stepped section, said downwardly stepped section disposed and sized to receive said stiffening pad when a respective lid member is in an open condition.

4. The container assembly according to claim 2 including a plurality of side wall hinge elements disposed in longitudinally spaced arrangement along each opposed side wall, wherein each said box section has external surfaces, and wherein the external surfaces of each said box section are disposed in substantial coplanar alignment.

5. The container assembly according to claim 3 including a plurality of side wall hinge elements disposed in longitudinally spaced arrangement along each opposed side wall, and further including projection means extending from the respective upper surfaces of each of said lid members, wherein said opposed side walls taper downwardly and inwardly to thereby define a clearance space for reception of said projection means from said lid member upper surfaces when said lid members are in an open condition.

6. The container assembly according to claim 2 including a plurality of side wall hinge elements longitudinally spaced along each opposed side wall and a plurality of cooperating lid member hinge elements longitudinally spaced along each lid member, said side wall hinge elements each comprising a pivot pin fixedly secured to said respective opposed side wall, the cooperating lid member hinge elements each comprising a split, substantially tubular hinge knuckle, said hinge knuckle received on the cooperating pivot pin for pivotal movement therewith.

7. The container assembly according to claim 6 in which said hinge knuckles are formed of resilient material, and wherein the splits on alternate hinge knuckles are arranged in an oppositely facing disposition.

8. The container assembly according to claim 5 in which said projection means extending from the respective upper surfaces of each of said lid members includes a plurality of mutually spaced projections, said mutually spaced projections defining channels operative to restrict the longitudinal and lateral movement of a similarly formed container assembly when positioned thereon.

9. The container assembly according to claim 8 including a plurality of feet projecting from the exterior surface of the bottom of said container body in a substantially rectangular footprint, said feet being sized and configured for substantially close clearance reception in said channels.

10. The container assembly according to claim 9 wherein, when said lid members are in a closed position, said mutually spaced projections and defined channels present a repeating bilaterally symmetrical pattern dividing the respective upper surfaces of said lid members into thirds on a length-to-width ratio of about three-to-two.

11. The container assembly according to claim 10 in which said container footprint has a length-to-width ratio of three-to-two and said repeating bilaterally symmetrical patterns cooperate therewith for stacking layers of similarly-formed container assemblies in alternate, perpendicularly related layers.

12. The container assembly according to claim 2 in which said opposed side and end walls taper downwardly and inwardly for nested reception in a similarly formed container assembly having its lid members in an open condition, and limit stop means projecting from the exterior surface of said opposed side and end walls at the intersection of said opposed side and end walls, said limit stop means adapted for engagement with a similarly formed subjacent container assembly to restrict the extent of nesting of said container assembly and said similarly formed subjacent container assembly.

13. The container assembly according to claim 12 in which the extent of nesting of said container assembly and said similarly formed subjacent container assembly is restricted by said limit stop means to no greater than the exposed free surface of the container bodies of said container assembly and said similarly formed subjacent container assembly with their respective lid members in an open condition.

14. The container assembly according to claim 13 in which the extent of nesting of said container assembly and said similarly formed subjacent container assembly is restricted to no greater than about one-half the vertical height of the opposed side and end walls of said container assembly.

15. The container assembly according to claim 12 in which said limit stop means comprises a plurality of spaced, depending ribs having lower ends forming shoulders for engagement with the upper ends of the walls of a subjacent container body when the container bodies of said container assembly and said similarly formed subjacent container assembly are disposed in a nested configuration.

16. The container assembly according to claim 12 in which the interior and exterior surfaces of said opposed side and end walls are formed with alternating recesses and projections configured and sized for alternate reception by the recesses and projections of a similarly formed adjacent container assembly when the container bodies of said container assembly and said similarly formed adjacent container assembly are disposed in a nested configuration.

17. The container assembly according to claim 2 in which said aperture means includes an enlarged portion, an edge forming a lower side of said enlarged portion having a depending recess configured to receive said spigot when in its operative position, and shoulder means formed on said closure plate adapted to engage said lower side of said enlarged portion to maintain said closure plate elevated above said depending recess when said closure plate is in its closed position.

18. A container assembly adapted to form part of a fluid delivery system comprising:

an open-topped container body including:

a generally rectangular bottom and rectangularly arranged opposed side and end walls extending upwardly from said bottom, an access aperture formed in one of said opposed end walls, said access aperture forming an opening for access to a spigot on a fluid-filled bag deposited in said container assembly, and a closure plate mounted on said one of said opposed end walls to close said access aperture, mounting means for mounting said closure plate for movement between a position overlying said access aperture and a position remote therefrom whereby said access aperture can be selectively opened and closed, and elongated slots on opposite sides of said aperture and lugs on a surface of said closure plate for reception in said slots, said lugs being slidably moveable within said slots for movement between said overlying and remote positions of said closure plate, and wherein said access aperture includes an enlarged portion, an edge forming a lower side of said enlarged portion having a depending recess configured to receive said spigot when in its operative position, and shoulder means formed on said closure plate adapted to engage said lower side of said enlarged portion to maintain said closure plate elevated above said depending recess when said closure plate is in its closed position; and a pair of opposed lid members each having a side edge pivotally secured to a respective upper end of one of said opposed side walls for pivotal movement between a generally horizontal position closing the top of said container body and an open condition in which each said lid member is generally vertically disposed in close proximity to the respective opposed side wall to which its side edge is pivotally secured, and at least one side wall hinge element an each of said opposed side walls and at least one cooperating lid member hinge element on each of said lid members for operative engagement therewith, each of said lid members including a generally flat region adjacent said side edge, each of said lid members also having a box section adjacent each lid member hinge element thereon, each said box section extending substantially perpendicular to said side edge and each said box section providing stiffening to a respective lid member hinge element, and each of said opposed side walls including a side wall recess adjacent each side wall hinge element thereon, each said side wall recess disposed and sized to receive the box section of a respective lid member when said respective lid member is in an open condition.

* * * * *